United States Patent [19]

Sauber

[11] Patent Number: 5,022,489

[45] Date of Patent: Jun. 11, 1991

[54] HOISTING APPARATUS FOR A MANHOLE

[75] Inventor: Charles J. Sauber, Virgil, Ill.

[73] Assignee: Sauber Mfg. Co., Virgil, Ill.

[21] Appl. No.: 538,982

[22] Filed: Jun. 15, 1990

[51] Int. Cl.[5] ..... A62B 1/16; A62B 35/00; B66C 23/18

[52] U.S. Cl. ..... 182/3; 182/145; 212/254

[58] Field of Search ..... 182/3, 5, 6, 7, 142, 182/145; 212/254

[56] References Cited

U.S. PATENT DOCUMENTS

| | | | |
|---|---|---|---|
| 4,440,261 | 4/1984 | Clark | 182/142 |
| 4,589,523 | 5/1986 | Olson | 182/239 |
| 4,660,679 | 4/1987 | Ostrobrod | 182/5 |
| 4,838,439 | 6/1989 | Baziouk | 182/3 |

*Primary Examiner*—Reinaldo P. Machado
*Attorney, Agent, or Firm*—Leydig, Voit & Mayer

[57] ABSTRACT

A hoisting apparatus for a manhole adapted to be fastened to a guardrail of a manhole. The hoisting apparatus is vertically spaced above and extends across the manhole. The hoisting apparatus has two operating positions enabling it to raise an object out of the manhole, maneuver the object horizontally over a surface area adjacent to the manhole, and lower the object onto the adjacent surface area. Likewise, the hoisting apparatus can be utilized to raise an object off the adjacent surface area, maneuver the object over the manhole, and lower the object into the manhole. Furthermore, the hoisting apparatus is lightweight, portable, and mechanically non-complex.

10 Claims, 2 Drawing Sheets

HOISTING APPARATUS FOR A MANHOLE

FIELD OF THE INVENTION

The present invention relates generally to portable devices for lifting objects from manholes, and more particularly is directed to an apparatus for hoisting objects from manholes that can be fastened to a guardrail of a manhole.

BACKGROUND OF THE INVENTION

Manholes provide access to underground networks. For example, in urban areas underground networks for utility and sewage systems are generally accessible via manholes. Both underground personnel and working materials enter and exit the underground networks via the manholes. Devices for lowering and raising working materials are utilized for assisting underground workers transport necessary equipment into and out of the manholes. These hoisting devices can be bulky and cumbersome and get in the way of underground workers who wish to enter or exit a manhole having a hoisting device over it.

Conventional fixed manhole hoisting devices are not only cumbersome, but they can only raise and lower objects vertically and are not capable of horizontally maneuvering hoisted objects. Once an object is raised out of a manhole, workers must maneuver the object away from the manhole and over a surface area adjacent to the manhole where the object can be lowered onto the adjacent surface area.

The inventor is not presently aware of hoisting devices that are designed to be secured to a conventional manhole guardrail. It would thus be desirable to provide a hoisting apparatus for a manhole which is compact, lightweight, capable of maneuvering objects horizontally, and formed from a minimum number of non-complex parts.

OBJECTS AND SUMMARY OF THE INVENTION

It is, therefore, a primary object of the present invention to provide a hoisting apparatus for a manhole which is compact and portable. The present invention provides a hoisting apparatus utilizing equipment available on location thus enabling the hoisting apparatus to be lightweight and mechanically non-complex.

A further object of the present invention is to provide a hoisting apparatus capable of horizontally maneuvering a raised object. The present invention enables an operator to raise an object out of a manhole while also enabling the operator to position the object over a surface area adjacent to the manhole onto which the object can be lowered. Likewise, the present invention enables an operator to raise an object off the surface area adjacent to the manhole, maneuver the object over the manhole, and lower the object into the open manhole.

In general, the present invention contemplates a hoisting apparatus for a manhole adapted to be secured to a guardrail of a manhole. The hoisting device includes a horizontal rotatable shaft for winding up a retrieving line that is vertically spaced above and extends across the manhole. The hoisting apparatus is lightweight, portable and mechanically non-complex. The present invention has two operating positions enabling an operator to hoist an object out of the manhole, maneuver it horizontally over a surface area adjacent to the manhole, and lower the object onto the adjacent surface area. The hoisting apparatus can be manually operated and includes a ratchet to prevent bidirectional rotation of the horizontal rotatable shaft during manual operation.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 illustrates the present invention being utilizes to raise an injured worker out of a manhole.

FIG. 2 illustrates two operating positions of the present invention. In a first operating position an injured worker is being hoisted from a manhole, and in a second operating position, shown in phantom, an injured worker is being lowered onto a surface area adjacent to the manhole.

FIG. 4*a* illustrates the clamp being utilized to secure the guide plate to a manhole guardrail having a tubular frame, and FIG. 4*b* illustrates the same clamp in FIG. 4*a* being utilized to secure the guide plate to a manhole guardrail having a bar frame.

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENTS

Figure 1:
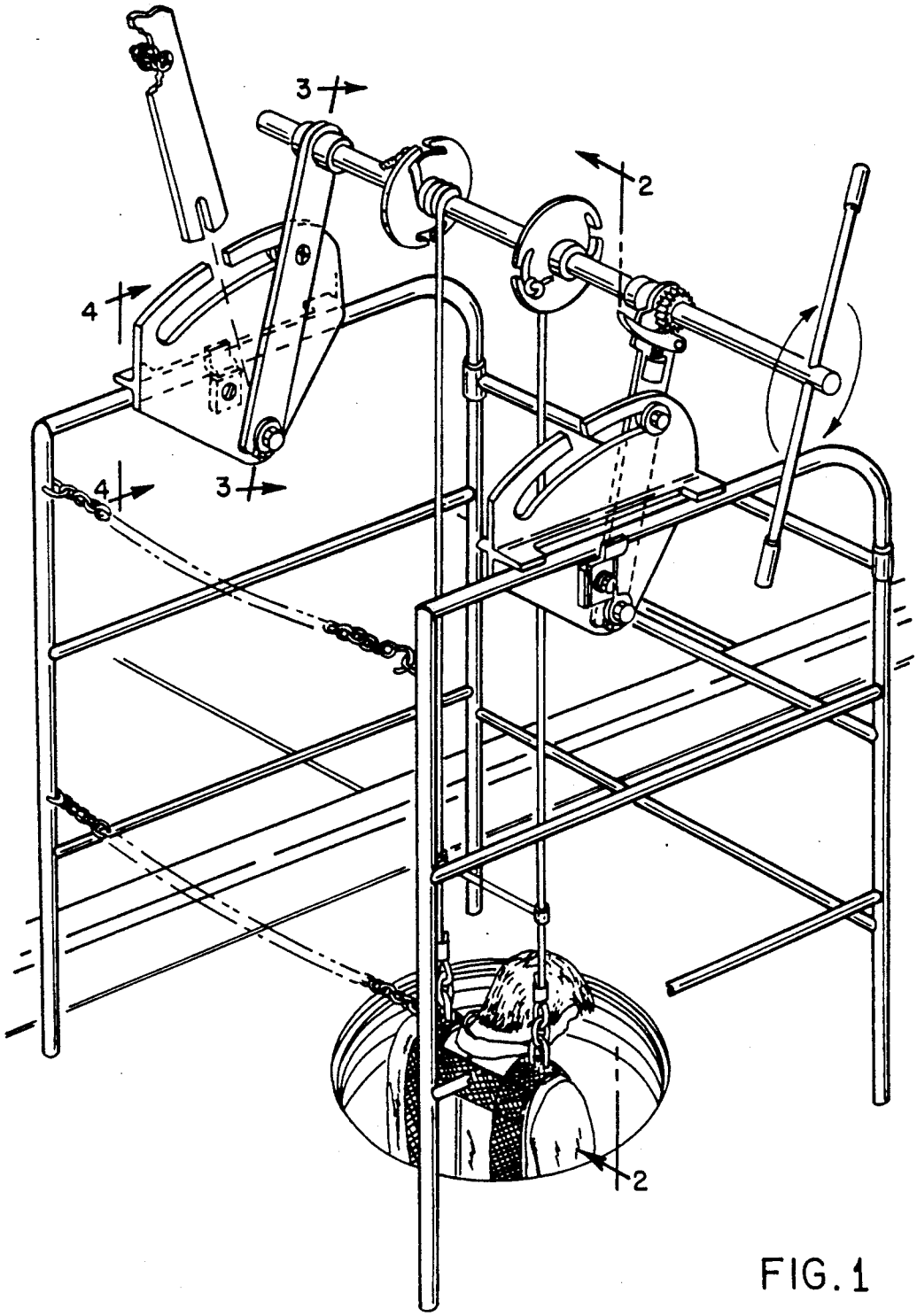
FIG. 1 is a perspective view of a hoisting apparatus for a manhole in accordance with the present invention.

Turning to the drawings, there is shown in FIG. 1 a hoisting apparatus for a manhole according to the present invention which is generally indicated by the reference numeral 10. The hoisting apparatus 10 includes a horizontal rotatable shaft 12 vertically spaced above and extending across a manhole 14. Means affixed to the shaft 12 for winding up retrieving line include two notched plates 16 which are attached to the shaft 12. Driving means adjacent one end of the shaft 12 for rotatably driving the shaft 12 and line retrieving means include a crank handle 18. In a preferred embodiment, each notched plate 16 has a plurality of notches 20 enabling retrieving lines 22 to be quickly secured to the horizontal rotatable shaft 12. By placing a knot 24 in one end of each retrieving line 22 and placing each knotted end 24 in a respective notch 20, each retrieving line 22 is quickly secured to the horizontal rotatable shaft 12 and ready to raise or lower an object out of or into the manhole 14.

The horizontal rotatable shaft 12 can be made from any rigid metal capable of maintaining its form while lifting objects usually raised from or lowered into manholes. Likewise, the notched plates 16 may be formed out of any material suited for the above-described purpose. Furthermore, the retrieving lines 22 may be any rope or the like capable of lifting objects usually raised from or lowered into manholes.

The crank handle 18, which is secured to one end of the horizontal rotatable shaft 12, may be any configuration that enables an operator to manually turn the horizontal rotatable shaft 12 and raise or lower a load attached to the retrieving lines 22. The crank handle 18 must be composed of a rigid material capable of maintaining its form while providing the necessary torque to the horizontal rotatable shaft 12 to raise and lower objects out of or into the manhole 14. The horizontal rotatable shaft 12 also includes a ratchet 26 to prevent bidirectional rotation of the horizontal rotatable shaft 12 during manual operation. The ratchet 26 may be substituted by other conventional devices capable of preventing bidirectional rotation of the horizontal rotatable shaft 12. The crank handle 18 may be replaced by a motor to drive the shaft 12. However, this would defeat an important aspect of the present invention, providing a manhole hoisting apparatus that is portable, lightweight, and mechanically non-complex.

In accordance with another important aspect of the present invention, a manhole hoisting apparatus capable of horizontally maneuvering lifted objects is provided by supporting the horizontal rotatable shaft 12 by two vertical supports 28 which are shiftable between two operating positions. Each of these vertical supports 28 is pivotally mounted to bracket means or guide members. In a preferred embodiment, the bracket means or guide members include guide plates 30. Each guide plate 30 includes a control slot 32 and a pivot bolt 34. Each vertical support 28 has a control bolt 36 and an assembly slot 38. Furthermore, each control slot 32 includes an assembly slot 40. Each guide plate 30 includes a clamp 42 for fastening each guide plate 30 to an upper portion of a frame 44 of a guardrail 46 of the manhole 14. Flanges 48 on each guide plate 30 rest on top of the upper portion of the frame 44 to support the hoisting apparatus 10.

Figure 2:
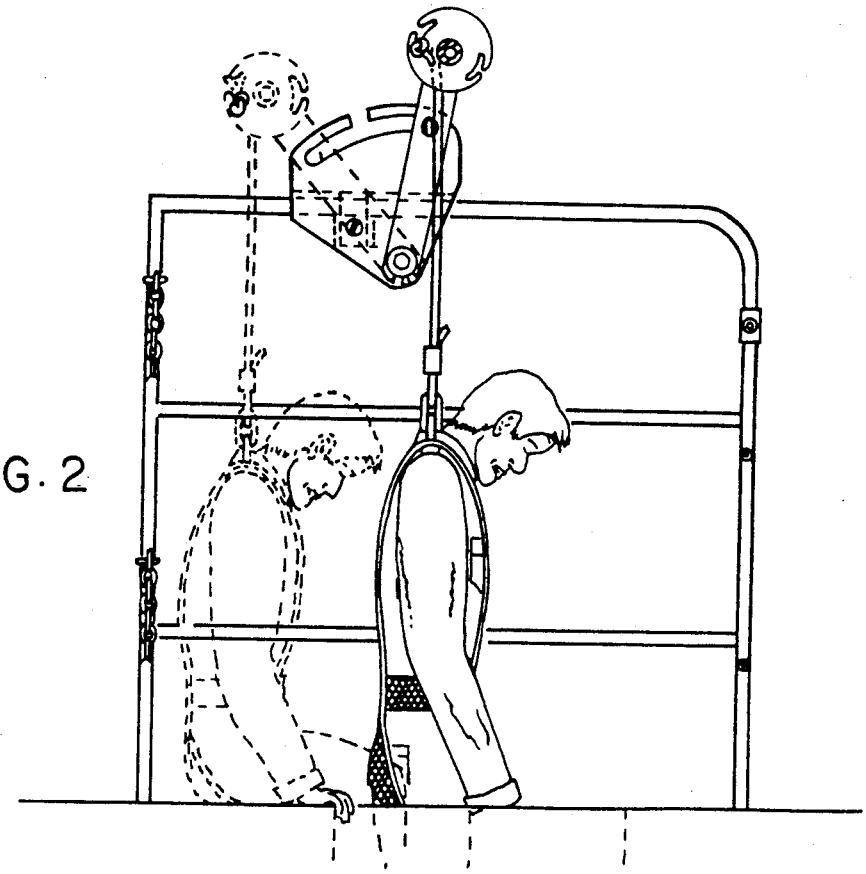
FIG. 2 is a side plan view of the hoisting apparatus shown in and taken along line 2—2 of FIG. 1.
Figure 3:
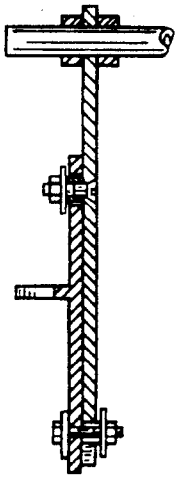
FIG. 3 is a cross-sectional view of the present invention shown in and taken along line 3—3 in FIG. 1. This view illustrates a guide plate, a vertical support and a horizontal rotatable shaft. A clamp which secures the guide plate to a manhole guardrail is not shown in FIG. 3.

The two operating positions are illustrated in FIG. 2 which exemplifies the hoisting apparatus 10 being utilized to raise an injured underground worker 48 out of the manhole 14. To raise the injured underground worker 48 out of the manhole 14, the vertical supports 28 are shifted to a first operating position 50 by rotating the vertical supports 28 on pivot bolts 34 until guide bolts 36, which slide within control slots 32, reach an extreme of control slots 32. Once the vertical supports 28 are positioned in the first operating position 50, the horizontal rotatable shaft 12 is turned to wind up the retrieving lines 22 and raise the injured underground worker 48 who is in a rescue harness 56 which is attached to the retrieving lines 22. Once the injured underground worker 48 is raised out of the manhole 14, the vertical supports 28 are shifted to a second operating position 52 by rotating the vertical supports 28 on pivot bolts 34. In the second operating position 52, the ratchet 26 is released allowing the horizontal rotatable shaft 12 to rotate in a direction that unwinds the retrieving lines 22 and lowers the injured underground worker 48 onto a surface area 54 adjacent to the manhole 14.

The hoisting apparatus 10 can be used to raise an object out of the manhole 14, maneuver the object horizontally over the adjacent surface area 54, and lower the object onto the adjacent surface area 54. Likewise, the hoisting apparatus 10 can be used to raise an object off the adjacent surface area 54, maneuver it horizontally over the manhole 14, and lower the object into the manhole 14. Although FIGS. 1 and 2 illustrate the hoisting apparatus 10 being utilized to retrieve an injured underground worker 48, the hoisting apparatus 10 can be utilized to raise and lower numerous articles out of and into the manhole 14, while also lifting articles off the adjacent surface area 54 or gradually lowering the articles onto the adjacent surface area 54.

In accordance with an additional, important aspect of the present invention, provision is made for securing the manhole hoisting apparatus 10 to a conventional manhole guardrail 46. To assemble the hoisting apparatus 10, the guide plates 30 are first secured to the upper portion of the frame 44 of guardrail 46. The flanges 48 on each guide plate 30 are set on top of the upper portion of the frame 44 and secured in place by clamps 42. Control bolts 36 are then inserted into respective control slots 32 via assembly slots 40 while simultaneously sliding assembly slots 38 around the pivot bolts 34. The control bolts 36 moving within the control slots 32 define two operating positions of the hoisting apparatus 10. Knots 24 are made in one end of each retrieving line 22 and inserted into respective notches 20 of the notched plates 16.

Figure 4A:
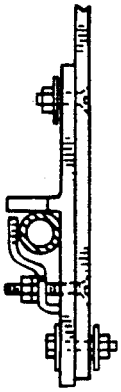
FIGS. 4*a* and 4*b* are cross-sectional views of the clamp, guide plate, vertical support and frame of the manhole guardrail shown in and taken along line 4—4 in FIG. 1.
Figure 4B:
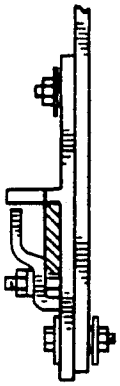

FIG. 4*a* illustrates the clamp 42 being utilized to secure the guide plate 30 to the tubular frame 44 of the manhole guardrail 46. Similarly, FIG. 4*b* illustrates the same clamp 42 being utilized to secure the guide plate 30 to a bar frame 60 of a manhole guardrail 46 (only a cross-section of the bar frame 60 is illustrated).

The hoisting apparatus 10 is easily and inexpensively manufactured, portable and lightweight because it utilizes equipment on location. The hoisting apparatus 10 provides the convenience of being able to be quickly and easily secured to the manhole guardrail 46. Furthermore, the hoisting apparatus 10 is mechanically non-complex, thus reducing the potential for equipment failure. Even more so, the hoisting apparatus 10 enables an operator to horizontally maneuver a raised object, thus allowing the operator to raise and lower an object off of and onto the surface area 54 adjacent to the manhole 14 in addition to raise and lower the object out of and into the manhole 14.

I claim as my invention:

1. A hoisting apparatus for a manhole adapted to be fastened to a guardrail of a manhole, the hoisting apparatus comprising:

a horizontal rotatable shaft adapted to extend across a manhole opening and be vertically spaced above the manhole;

means affixed to the shaft for winding up retrieving line;

bracket means adjacent opposite ends of the shaft for rotatably supporting the shaft;

clamping means for mounting the bracket means to the manhole guardrail;

driving means adjacent one end of the shaft for rotatably driving the shaft and line retrieving means; and said bracket means enabling the shaft to be positioned over the manhole.

2. The hoisting apparatus as defined in claim 1, wherein the bracket means include:

vertical supports for positioning the horizontal rotatable shaft at a second operating position for raising and lowering objects off of and onto a surface area adjacent to the manhole.

3. The hoisting apparatus as defined in claim 2, in which the bracket means include guide plates for pivotally mounting the vertical supports, and wherein the vertical supports are pivotable to the first operating position for raising and lowering objects into and out of the manhole, and pivotable to the second operating position for raising and lowering objects off of and onto a surface area adjacent to the manhole.

4. The hoisting apparatus as defined in claim 3, in which each vertical support includes a control bolt in an upper portion of each vertical support, each guide plate includes a control slot in an upper portion of each guide plate, and wherein each control bolt fits into a respective control slot so as to define the first and second operating positions.

5. The hoisting apparatus as defined in claim 3, wherein the clamping means secure the guide plates to at least one of a tubular frame and a bar frame of a manhole guardrail.

6. The hoisting apparatus as defined in claim 1, wherein the driving means adjacent one end of the shaft include a crank handle for manually rotating the rotatable shaft in order to raise and lower objects, and the hoisting apparatus further includes:

a ratchet attached to the horizontal rotatable shaft for preventing bidirectional rotation of the horizontal rotatable shaft during manual operation.

7. The hoisting apparatus as defined in claim 1, wherein the means affixed to the shaft for winding up retrieving line include a notched plate affixed to the horizontal rotatable shaft enabling the retrieving line to be quickly fastened to the horizontal rotatable shaft by inserting a knotted end of the retrieving line into a notch on the notched plate.

8. The hoisting apparatus as defined in claim 3, wherein a lower part of each vertical support includes a u-shaped assembly slot adapted to slip around a pivot bolt located on a lower part of each guide plate, and each control slot includes an assembly slot enabling a respective control bolt of each vertical support to quickly slip into the control slot of a respective guide plate.

9. The hoisting apparatus as defined in claim 2, wherein a rescue harness is attached to one end of the retrieving line, thereby enabling an injured underground worker to be lifted out of the manhole, maneuvered horizontally over the adjacent surface area, and gradually lowered onto the adjacent surface area.

10. A hoisting apparatus for a manhole adapted to be supported vertically over a manhole, comprising in combination:

a horizontal rotatable shaft adapted to be positioned vertically spaced above and across a manhole;

means affixed to the shaft for winding up retrieving line;

a pair of spaced apart vertical supports rotatably supporting the horizontal rotatable shaft;

guide members associated with respective ones of the vertical supports pivotally mounting the vertical supports; and said vertical supports being rotatably shiftable between a first operating position for raising and lowering objects into and out of the manhole, and a second operating position for raising and lowering objects off of and onto a surface area adjacent to the manhole.

* * * * *